US007240445B2

(12) United States Patent
Barlow

(10) Patent No.: US 7,240,445 B2
(45) Date of Patent: Jul. 10, 2007

(54) INFLATABLE DISPLAY APPARATUS

(75) Inventor: William Richard Barlow, 20713 Rockcroft Dr., Malibu, CA (US) 90265

(73) Assignee: William Richard Barlow, Malibu, CA (US)

( * ) Notice: Subject to any disclaimer, the term of this patent is extended or adjusted under 35 U.S.C. 154(b) by 24 days.

(21) Appl. No.: 10/768,071

(22) Filed: Feb. 2, 2004

(65) Prior Publication Data

US 2005/0166433 A1 Aug. 4, 2005

Related U.S. Application Data

(60) Provisional application No. 60/524,627, filed on Nov. 25, 2003, provisional application No. 60/524,628, filed on Nov. 25, 2003.

(51) Int. Cl.
*G09F 15/00* (2006.01)

(52) U.S. Cl. ..... 40/610; 40/624; 114/292; 114/61.1; 114/121

(58) Field of Classification Search ..... 40/215, 40/606.18, 610, 623, 736; 446/220; 441/36, 441/40; 114/343, 61.1, 121, 122
See application file for complete search history.

(56) References Cited

U.S. PATENT DOCUMENTS

| | | | | |
|---|---|---|---|---|
| 803,084 | A | 10/1905 | Alexander | |
| 1,677,450 | A | 7/1928 | Iden | |
| 3,086,752 | A * | 4/1963 | Wetter | 254/420 |
| 3,089,157 | A * | 5/1963 | May | 441/79 |
| 3,649,978 | A * | 3/1972 | Monnereau | 114/266 |
| 4,178,706 | A | 12/1979 | Boyce | |
| 4,179,832 | A | 12/1979 | Lemelson | |
| 4,369,591 | A | 1/1983 | Vicino | |
| 4,416,073 | A | 11/1983 | Vicino et al. | |
| RE33,709 | E | 10/1991 | Vicino | |
| 5,197,821 | A * | 3/1993 | Cain et al. | 405/68 |
| 5,357,895 | A | 10/1994 | Ceko | |
| 6,240,666 | B1 * | 6/2001 | Apel et al. | 40/610 |
| 6,338,307 | B1 * | 1/2002 | Pires | 114/61.1 |
| 6,347,470 | B1 | 2/2002 | Radovich | |

FOREIGN PATENT DOCUMENTS

| | | | |
|---|---|---|---|
| WO | WO 02/47057 | * 6/2002 | 40/610 |

* cited by examiner

*Primary Examiner*—Cassandra Davis
(74) *Attorney, Agent, or Firm*—Bacon & Thomas, PLLC

(57) ABSTRACT

A display apparatus having a base portion and a display support portion extending vertically from the base portion. At least one display feature bearing at least one graphic presentation is connected to the display apparatus. More specifically, the display apparatus includes elongate pontoons, a plurality of column members extending from each of the pontoons, an elongate transverse member with each of the column members connecting thereto, and a plurality of cross-members extending between the pontoons. The pontoons, the column members, the transverse member and the cross-members each comprise an independently inflatable compartment. The display apparatus further comprises a ballast system including elongate ballasts mounted to the pontoons, and display features removably affixed to the column members which extend between the transverse member and the pontoons.

20 Claims, 4 Drawing Sheets

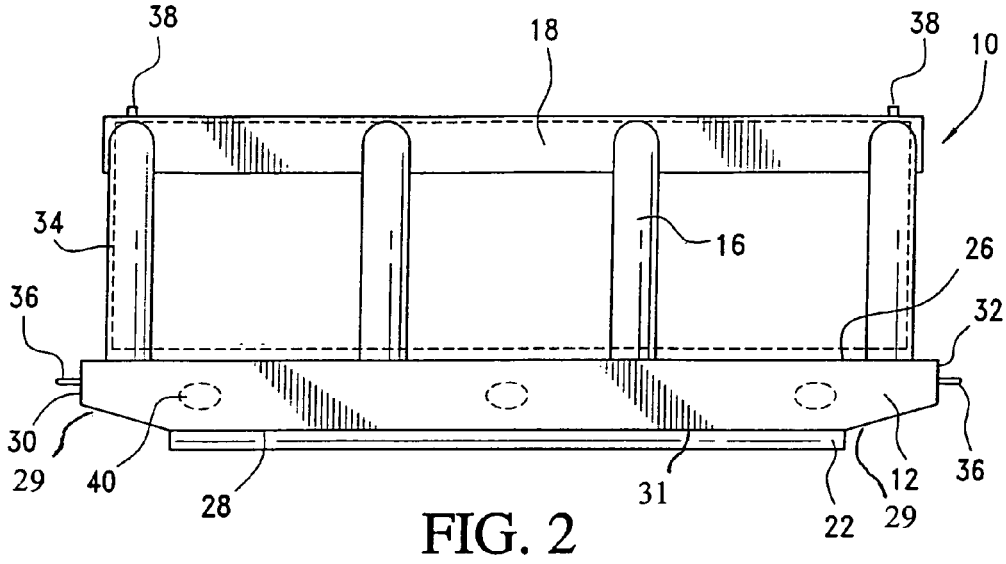
FIG. 2
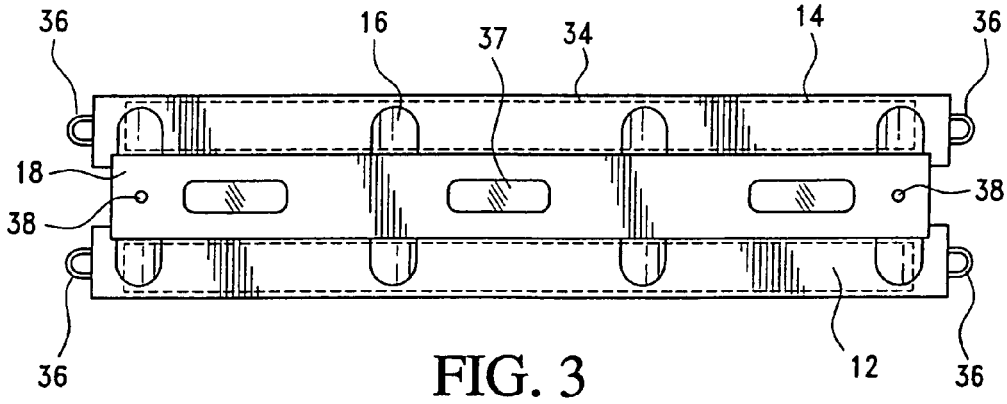
FIG. 3
FIG. 4
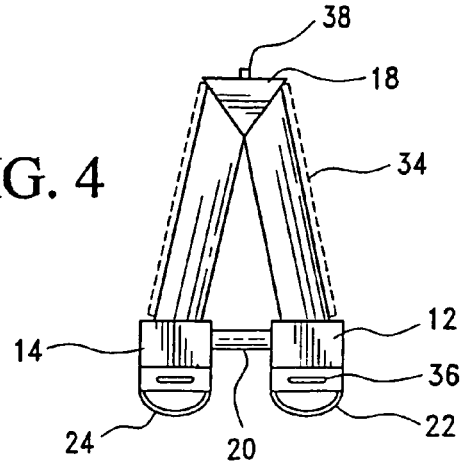

FIG. 8
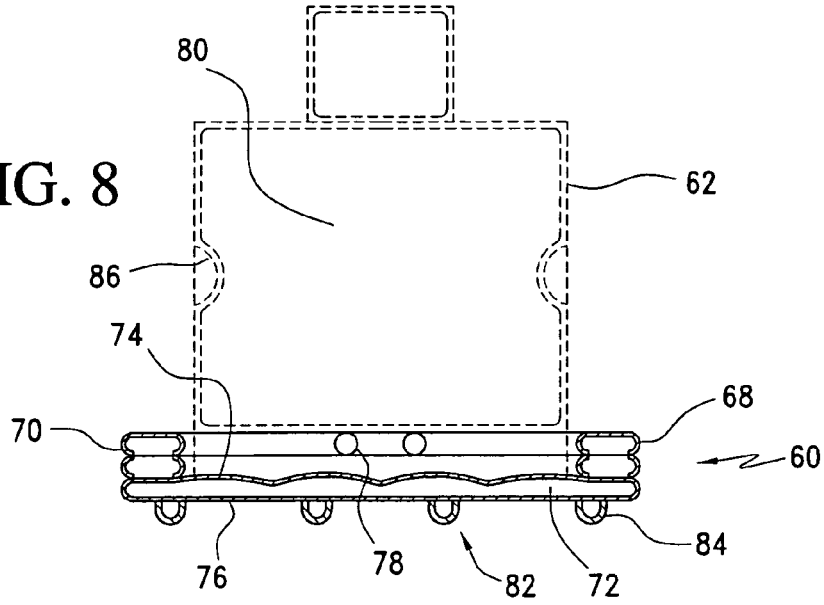
FIG. 9
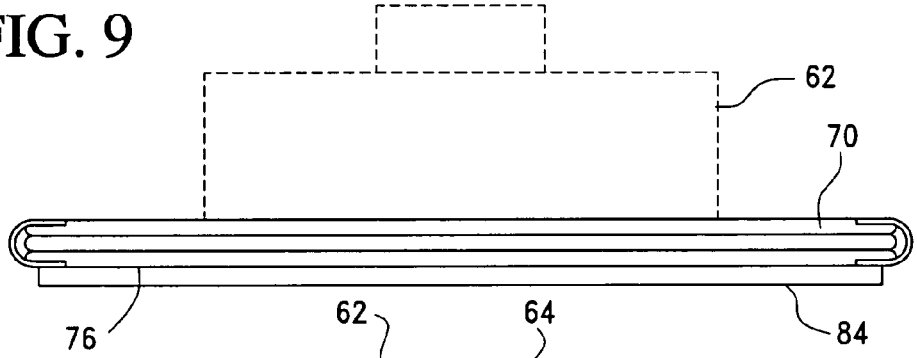
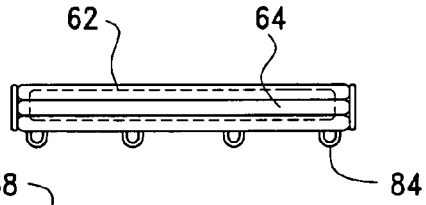
FIG. 10
FIG. 11
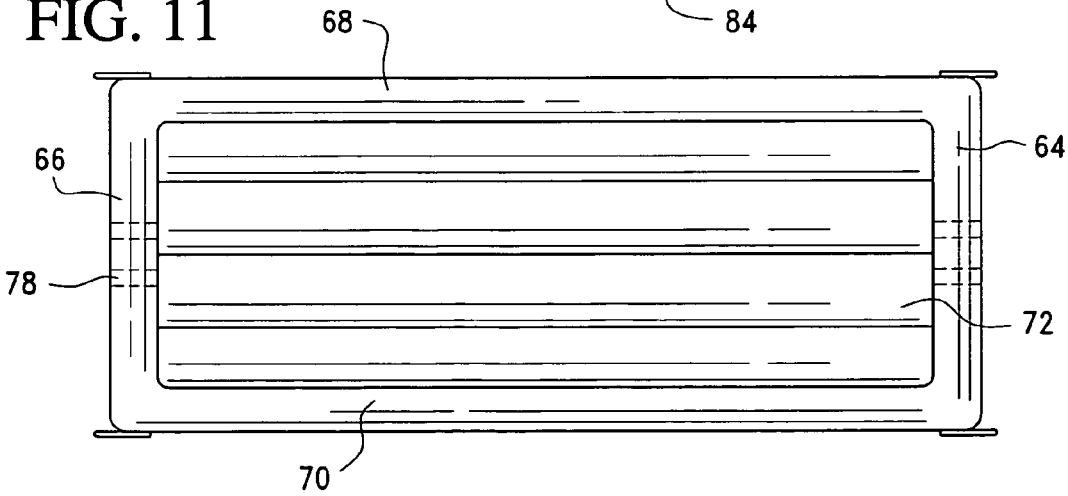

INFLATABLE DISPLAY APPARATUS

This application claims the benefit of U.S. Provisional Application 60/524,627 filed Nov. 25, 2003, and U.S. Provisional Application 60/524,628 filed Nov. 25, 2003. This application relates to co-pending U.S. Non-Provisional Application 10/768,072 simultaneously filed Feb. 2, 2004.

BACKGROUND OF THE INVENTION

1. Field of the Invention

The invention relates to an inflatable display apparatus having a plurality of inflatable structural members and at least one display panel or three-dimensional inflatable display. When used in a marine environment, the display apparatus comprises a ballast system including at least one elongate ballast mounted to a bottom surface thereof to provide stability and guidance while floating on a water surface.

2. Discussion of Related Art

Outdoor billboard and advertising installations are well known. For many years, billboards have been installed along the nation's highways and have served as useful tool for reaching driving audiences. Advertising installations such as electric signs are commonly used by vendors to attract customers and provide notice of events. Billboards and advertising installations are also frequently used at local events and attractions such as fairs, festivals, retail establishments and sporting events.

Another type of outdoor advertising is the use of portable billboards or banners carried by planes, automobiles and blimps. For example, it is well known to fly airplanes or blimps carrying banners or graphic presentations that promote local events, services or products above crowds gathered at sporting events, parks and city streets. Moreover, it is also common to employ a truck or van to transport a billboard display in crowded cities and towns advertising a new product, event or service.

Heretofore, there has been no successful portable outdoor advertising scheme employed for a marine environment such as those directed to crowds along waterfronts or coastlines. It is thus highly desirable to provide a display apparatus capable of providing an advertising scheme capable of reaching crowded beaches or parks located along a waterfront or coastline.

An increasing problem is being encountered pertaining to laws and local ordinances prohibiting, limiting or requiring licensing of billboards and other forms of outdoor advertising. Often these regulations relate to the degree of permanency of advertising matter, being more stringent the more permanent the advertising installation becomes. Regulations vary from outright bans on billboards along interstate highways, waterfronts, and coastlines to restrictions on sign styles and size above a business establishment.

Advertisement of alcohol and tobacco products is severely limited through radio and television, and modes of outdoor advertising of the types discussed above are frequently used instead. Nonetheless, many localities place restrictions or even outright bans on advertising of alcohol and tobacco on beaches, and accordingly, it is difficult to reach crowds of beachgoers with alcohol and tobacco advertising. Moreover, advertisers in general have very few outlets to reach beach crowds and are typically limited to trash can ads, bus benches, parking lot fliers or airplanes. It will be noted, however, that offshore areas a certain distance from the shore are often exempt from local ordinances since such waters are outside the jurisdiction of these localities.

Accordingly, crowds of beachgoers can be reached with advertising if such advertising is located a distance from shore.

To overcome many of the impediments of known modes of advertising, it has been proposed to provide an advertising display apparatus that can reach crowds along a waterfront or coastline while complying with local ordinances or capable of displaying advertisements a distance from a waterfront or coastline outside of such local jurisdictions. Moreover, it is desirable to provide a display apparatus of simple construction that is versatile in that it may be used in both marine environments and on dry ground, and further may be easily adaptable to include different advertising displays.

SUMMARY OF THE INVENTION

In accordance with the invention, different embodiments of a display apparatus are provided which satisfy existing needs for a display apparatus that can carry an advertising display, and is useable in both a marine environment and on dry ground.

The present invention provides an advertising display which comprises a display apparatus having a base portion, and a display support portion extending vertically from the base portion. The advertising display includes at least one display feature that is connected to the display apparatus along at least one side of the display support portion and bears graphical presentations. The advertising display may be floatable and further comprise at least one tow device that is mounted along one of the ends of the display apparatus. The display apparatus can be partially or wholly inflatable, and may include a plurality of individually inflatable compartments.

In an embodiment of the invention, the display apparatus comprises two elongate pontoons provided in parallel arrangement, a plurality of column members extending in a row from a first side of each of the pontoons, an elongate transverse member provided in parallel arrangement to the pontoons with each of the column members connecting to the transverse member. The pontoons, the column members and the transverse member each comprise at least one independently inflatable compartment.

The display apparatus may further comprise a ballast system, for use in a marine environment or on dry ground, including elongate ballasts mounted to a second surface of the pontoons, and display panels removably affixed to the rows of the column members and extending between the transverse member and the pontoons. Numerous lighting configurations may be provided on the members of the display apparatus and the display panel, both for functional and ornamental purposes.

Conventional display apparatuses are typically dull, expensive, restricted in a particular application or environment. Moreover, such display apparatuses are mainly one-dimensional and limited in size. The embodiments of the display apparatus of this invention can be located in a variety of locations, and are particularly adapted for a marine environment for reaching a viewing audience along a waterfront or coastline. When in a marine environment, the display apparatus may be adapted to be towed by a watercraft in reversible directions and further, multiple display apparatuses may be connected to one another in a train formation and towed simultaneously by such watercraft. Furthermore, the display apparatus may include self-propulsion and navigational devices controlled by radio or wirelessly which permit the display apparatus to be transported without a watercraft.

The display apparatus may carry a variety of advertising displays, and further be adapted to carry public service announcements. Whether it is a display panel or an inflatable display, the display apparatus can accommodate message areas that can be personalized or tailored to meet any viewing audience. In addition, the display apparatus can be scaled to meet any appropriate application, and may include interactive features for attracting and communicating with people.

The new and novel embodiments of the display apparatus are versatile in that they may be used on both dry ground and marine environments. Operation of the display apparatus is generally uncomplicated, safe and does not pose a public nuisance. Moreover, due to their inflatable nature, the display apparatus is simple in construction, relatively inexpensive to manufacture, and can be stored with ease in minimal spaces.

BRIEF DESCRIPTION OF THE DRAWINGS

Objects and many attendant advantages of the present invention will be readily appreciated as the same becomes better understood by reference to the following detailed description when considered in connection with the accompanying drawings in which like reference numerals designate like parts throughout the figures thereof and wherein:

FIG. 2 is an elevational side view of a display apparatus according to a first embodiment of the invention;

FIG. 3 is top plan view of the display apparatus of FIG. 2;

FIG. 4 is a front elevational view of the display apparatus of FIG. 2;

FIG. 8 is an elevational sectional view of another embodiment of the display apparatus of the invention;

FIG. 9 is an elevational side view of the display apparatus exemplified in FIG. 8;

FIG. 10 is an elevational front view of the display apparatus exemplified in FIG. 8; and FIG. 11 is a top plan view of the display apparatus exemplified in FIG. 8.

DETAILED DESCRIPTION OF THE PREFERRED EMBODIMENTS

Figure 1:
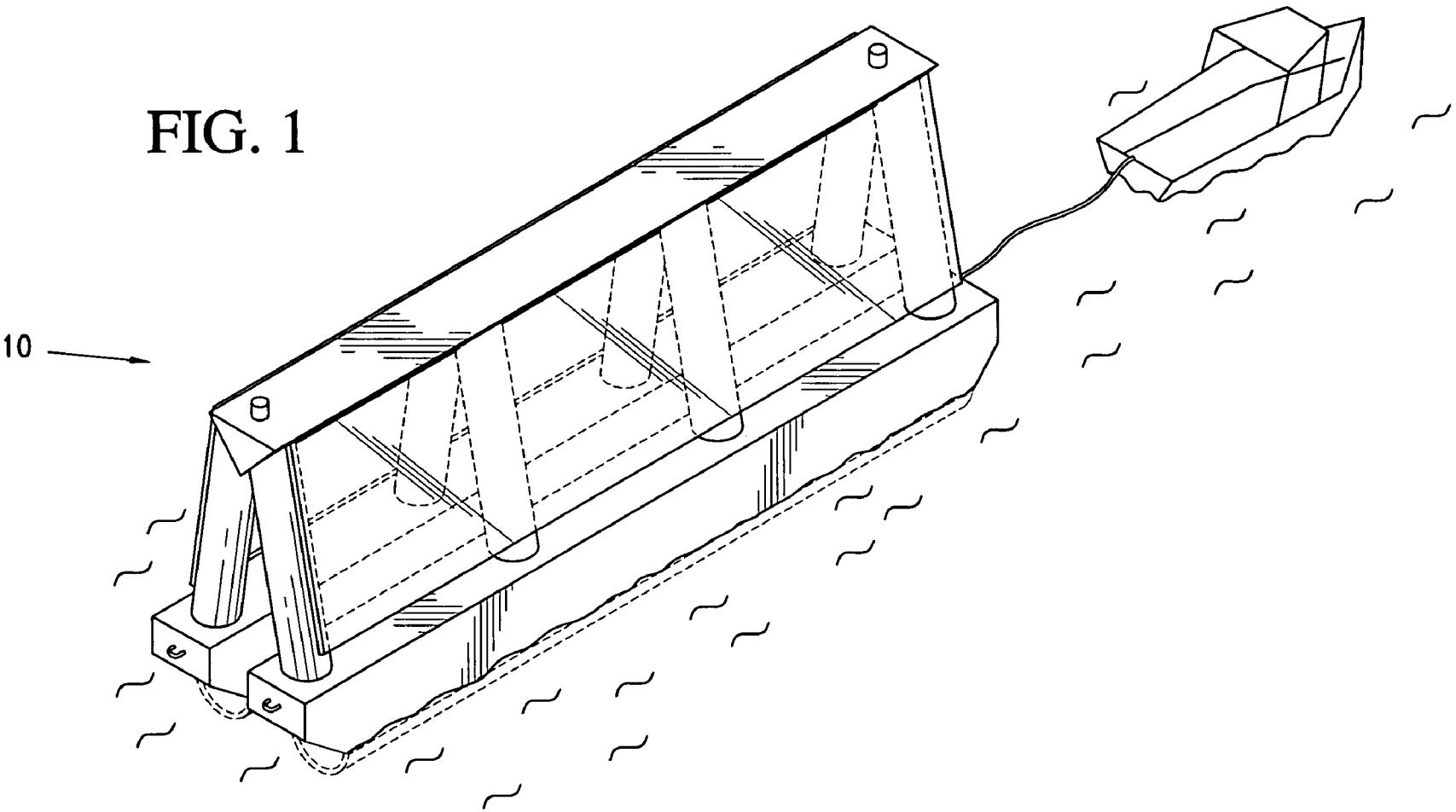
FIG. 1 is a schematic perspective view of a display apparatus being towed by a watercraft.

Turning to FIG. 1, an embodiment of the display apparatus 10 is depicted as being towed by a watercraft. This embodiment is depicted in greater detail in FIGS. 2-4, wherein the display apparatus 10 comprises two elongate pontoons 12, 14 provided in parallel arrangement. Each pontoon 12, 14 is defined as having opposed first and second ends 30, 32, and first and second sides 26, 28. Each second side 28 includes a substantially horizontally extending surface 31 at a middle portion, and generally short or stubbed, tapered or sloped end surfaces 29 at each end portion. The tapered or sloped end surfaces 29 extend obliquely from the substantially horizontally extending surface 31, as can be seen in FIG. 2. The display apparatus 10 further comprises a plurality of column members 16 that extend from the first side 26 of each of the pontoons 12, 14 and are preferably arranged in uniformly spaced rows. Each of the column members 16 connects to an elongate transverse member 18 spaced above and provided in parallel arrangement to the pontoons 12, 14. Moreover, the display apparatus 10 further comprises at least one cross-tube 20 that connects to and extends laterally between the pontoons 12, 14.

As shown in FIG. 4, the display apparatus 10 is generally trapezoidal in lateral cross-section such that the transverse member 18 generally defines a narrow top portion and the column members 16 extend therefrom at an acute angle, preferably in the range of 10 to 20° to the pontoons 12, 14. The pontoons 12, 14 define a wider bottom portion with the at least one cross-tube 20 extending between the pontoons 12, 14. This trapezoidal shape improves the stability of the display apparatus in the event of wind and inclement conditions and further provides a structure that enables clear visibility of a display panel attached to each row of column members.

Preferably, in this embodiment the pontoons, the column members, the transverse member and the cross-tubes each comprise at least one inflatable compartment. Each compartment is provided with a valve, such as a two-way Boston valve, and is separately inflatable. Moreover, it is preferred that the pontoons, column members, the transverse member, and the cross-tubes are constructed from water impermeable and an air-tight material, such as Tarpaulin or PVC coated vinyl, and include seams that are sewn, bonded, or both sewn and bonded together such as by radio frequency (RF) welding. Each of the members of the display apparatus may be constructed so as to have an internal bladder constructed of PVC and an external shell constructed of Tarpaulin.

The display apparatus 10 of this embodiment is arranged to support at least one display panel 34 that is removably affixed to at least one row of the column members 16 and generally extends between the transverse member 18 and one of the pontoons 12, 14. The display panel 34 may be a banner, placard, billboard or the like which is generally planar and has a leading edge, a trailing edge and two longitudinal edges. The leading and trailing edges of the display panel 34 can be connected to column members 16 corresponding to the first and second ends 30, 32 of the pontoons 12, 14. The display panel may be configured to extend along one of the rows of column members, or be configured to individually extend along both rows of the column members and over the transverse member. Moreover, the display panel 34 may comprise three-dimensional items such as inflatable objects and may include lighting elements disposed thereon.

The display panel 34 can be connected along its leading and trailing edges to corresponding column members and a corresponding longitudinal edge may be connected to the transverse member. Preferably, in one embodiment, the display panel, the transverse member and the column members include a plurality of matching fastener elements, such as stainless steel grommets, hook and loop fasteners, snap elements and the like, that are mounted, such as by being RF welded, to the aforesaid components of the display apparatus. The column members and transverse member in this embodiment include flaps that are attached thereto and which include a plurality of the fastener elements.

In one embodiment, the fastener elements are stainless steel grommets which are mounted on the flaps and the display panel. A nylon rope can be used to maintain the display panel sufficiently in place to the members of the display apparatus thereby permitting easy mounting and dismounting of the display panel.

Other configurations of the display panel and members of the display apparatus are intended to be within the scope of the instant application which may be used to connect the display panel to the display apparatus to maintain the display panel with the display apparatus in light to moderate winds, and inclement weather conditions, withstand towing by a watercraft, or be maintained in a stationary fashion.

Preferably, the display panel 34 comprises a billboard made of pliable and permeable material bearing graphic presentations including symbols, indicia, images and the like. The display panel may be constructed from any suitable material, such as nylon-poly mesh, that will permit the flow of air therethrough and the display of such display panel in light to moderate wind and inclement weather conditions.

Alternatively, the display panel may comprise a string of lights or an electronic sign instead of the aforementioned billboard-like display panel. Moreover, the display panel may include LCD and/or LED elements mounted thereon providing illumination or a visual display screen with moving images.

As shown in FIGS. 2-4, the display apparatus includes a ballast system 22, 24 mounted along the second side 28 of each of the pontoons 12, 14. In a preferred embodiment, the ballast system comprises elongate ballasts 22, 24 that define a conduit for the flow of fluid therethrough. Each pontoon 12, 14 is provided with an elongate ballast 22, 24 that extends generally along the second surface 28 thereof.

The ballasts 22, 24 may extend along the entire second side 28 of the pontoons 12, 14, or they may extend coextensively with the substantially horizontally extending surface 31 up to the tapered or sloped end surfaces 29, or they may extend only along a selected portion thereof. The ballast system may comprise a plurality of ballast segments mounted in a parallel or staggered configuration along the second surface of the pontoons, and further, the ballast segments may be mounted along side portions of the pontoons that are in contact with water.

Preferably, the ballasts are constructed of a material suitable for use in watercraft, such as Tarpaulin. While in the preferred embodiment the cross-sectional shape of the ballasts is shown to be semi-circular, the ballasts may define a plurality of shapes, such as circular, triangular, square and a variety of other suitable geometrical configurations.

Figure 5:
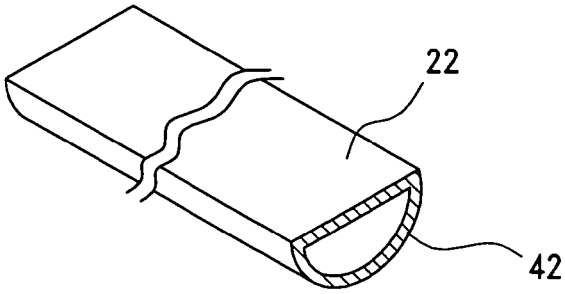
FIG. 5 is perspective sectional view of a ballast in FIG. 2.

As illustrated in FIG. 5, each ballast 22 preferably includes opposed end portions having sections reinforced with a structural material 42, such as PVC, such that the opposed end portions of the ballasts are structurally rigid for permitting access of fluid therethrough or having an inflated configuration whereby the end portions have gas chambers that maintain the ballast as an open conduit. The end portions may be sealed such that the fluid contained by the ballasts is trapped therein. Maintenance of the ballasts as an open conduit is desirable so at to prevent collapse of the ballasts and provide ample fluid transport therethrough.

The ballast system is provided as a means to maintain the display apparatus in upright position so as to prevent the display apparatus from tipping or flipping in inclement weather conditions. Moreover, the ballast system provides the display apparatus with directional guidance when it is floating on a body of water. It will be noted, however, that the ballast system may be removed from the display apparatus in the event the display apparatus is positioned on dry around.

When on dry ground, the display apparatus may be provided with removable axles carrying wheels that can be mounted, for example, on the second surface of the pontoons to facilitate the transport of the display apparatus on dry ground or along marine launching ramps. Furthermore, if the display apparatus is to be exhibited on dry ground, the ballasts may be filled with weight, such as water or sand. For example, bags or tubes filled of sand or water may be inserted into the interior area of the ballasts and the ballasts may be sealed at each end portion thereof to contain the weight therein.

Figure 6:
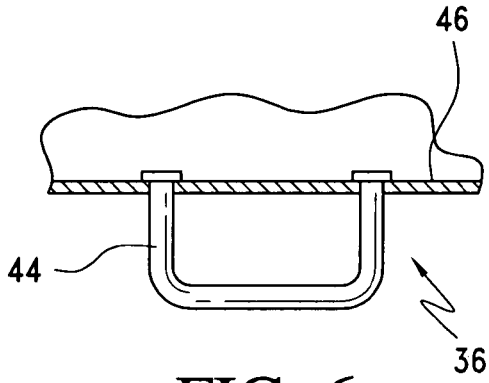
FIG. 6 is a perspective view of a tow device in FIG. 2.

As shown in FIGS. 2-4, the display apparatus 10 may include at least two tow devices 36 provided at the first and second ends 30, 32 of the pontoons 12, 14. In FIG. 6, a tow device 36 is depicted and includes an attachment element 44 mounted to a segment 46 of waterproof material, such as Tarpaulin. The segment of material 46 is subsequently mounted to an end of the pontoons as shown in FIGS. 2-4. Each tow device 36 may be mounted to the pontoons in any suitable manner, such by being sewn, bonded, or sewn and bonded by RF welding. The tow devices enable the display assembly to be towed generally in a straight line and provide stability and control when maneuvered.

A rope, cable or other suitable line element may be tied at one end to the preferred tow device and tied at another end to a watercraft towing the display apparatus. Multiple display apparatuses may be linked to one another by suitable line elements provided between the tow devices, whereby a train of at least two display apparatuses may be towed simultaneously by a watercraft.

The tow device of the invention is not limited to the aforementioned embodiment, and any tow device may be employed which permits the display apparatus to be connected to a watercraft and subsequently towed thereby without separation of the display apparatus from the watercraft. Moreover, the tow devices may serve as anchor line attachment points, if needed, if it desired to arrange the display apparatus in a static position on a body of water.

High wind tracking of the display apparatus may be provided to improve the navigation of the display apparatus by including a drag chute funnel or any other suitable drag control devices or arrangement. For example, the drag chute funnel may be connected at a trailing end of the display apparatus whereby the diameter of the funnel is adjustable in size to regulate the flow of water therein and therefore the drag of the display apparatus.

The display apparatus may include with an on-board propulsion arrangement such as a gas or electric motor. Moreover, the display apparatus may include a navigational arrangement, such as a mountable rudder, a keel, or other suitable marine navigational components known to those skilled in the art, as a substitute for or in combination with the ballast system. Such on-board propulsion and navigational arrangements may be provided with radio or wireless control features so as to render a towing watercraft unnecessary and permit someone along shore to direct the floating display apparatus.

The display apparatus may include a plurality of different lighting configurations having decorative and functional features. More specifically, in a preferred embodiment, the display apparatus includes a plurality of pockets positioned on the top of each of the columns wherein battery operated navigation lights 38 are provided. Spotlights or lamps 40 may be provided alongside the pontoons, and LCD/LEDs may be appropriately positioned on the display apparatus and panel as deemed necessary for a desired viewing display. Any of the lighting configurations can be provided with receivers that are arranged to receive radio or wireless control signals for operation thereof.

Figure 7:
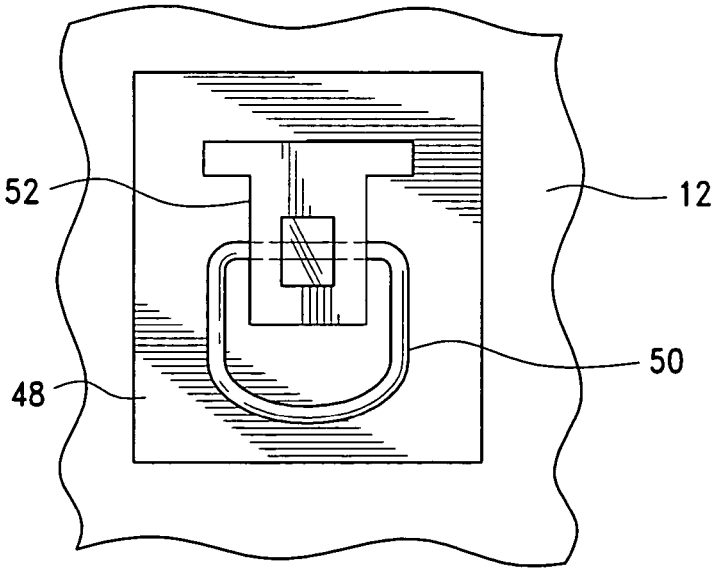
FIG. 7 is a perspective view of a lighting configuration of FIG. 2.

In a preferred embodiment shown in FIG. 7, a segment 48 of heat resistant material, such as that constructed of asbestos, may be mounted on the pontoons 12, 14. The heat resistant segment 48 is provided with a ring 50 which is sewn, bonded or welded thereon. An airtight, waterproof halogen light fixture 52 or similar light fixture may be strapped onto such heat resistant segment 48 with the fixture of a glass lens of the halogen light fixture 52 generally directed toward a display panel supported by the display apparatus. The halogen light fixture 52 may be connected to a power source carried by the display apparatus or on board a watercraft towing the display apparatus.

The display apparatus is not limited to the aforementioned lighting fixtures, and may include a variety of lighting configurations that may illuminate portions of the display panel, provide navigational means for the display apparatus, form portions of the display panel such as lighting elements, illuminate structural members of the display apparatus, and other lighting configurations rendered necessary or elected to be included on a display apparatus supporting display panels. Underwater lights may also be provided which cause the periphery of the display apparatus to glow in water.

The lighting configurations may be battery operated, or connected to a power source carried by the display apparatus, a watercraft, or a land based source. In the embodiment shown in FIG. 3, the power source comprises a plurality of solar panels 37 connected to an appropriate energy storage device. The solar panels may be placed any suitable location to receive solar radiation.

In another embodiment of the invention exemplified in FIGS. 8-11, the display apparatus 60 comprises a platform assembly 60 configured with an inflatable display 62. In this embodiment, the platform assembly 60 comprises a plurality of wall members 64, 66, 68, 70 surrounding a first surface 74 of a base member 72. The walls are divided into opposed first and second end walls 64, 66 and opposed first and second side walls 68, 70. The base member 72 comprises the first surface 74 and a second surface 76 opposed to the first surface 74.

In the preferred embodiment, the walls 64, 66, 68, 70 of the platform assembly 60 are mounted to the first surface of the platform. The walls are defined by a plurality of circuitous, separately inflatable members that may be connected to one another in a vertically arranged formation. In alternate embodiments, each wall may be defined as a separately inflatable member, or comprise of a plurality of inflatable members that may be vertically or horizontally arranged. Moreover, the walls may be comprised of a single inflatable member having different compartments or chambers which are separately inflatable.

The base portion 72 of the platform assembly 60 preferably comprises a plurality of separately inflatable members. The inflatable members of the base portion 72 may comprise a plurality of horizontally arranged longitudinally extending members generally parallel with the side walls 68, 70, a plurality of laterally extending members generally parallel with the end walls 64, 66 any combination of longitudinally and laterally horizontally extending members, or any deviation thereof. Moreover, the base portion 72 may comprise a plurality of members horizontally arranged, as described above, or vertically arranged.

The platform assembly 60 may also comprise a ballast assembly 82, as described above in connection with display apparatus 10. The ballast assembly 82 includes at least one elongate ballast 84 mounted on the second surface 76 of the base portion 72. As with the ballast assembly described above, the at least one elongate ballast 84 is particularly defined for providing a conduit of fluid to pass therethrough when the platform assembly is floating on a water surface. Moreover, as with the display apparatus 10 the at least one ballast may be filled with a weight, such as sand or water, and sealed at the end portions thereof in the event the platform assembly is on dry ground so as to maintain the platform assembly in a stable position.

In accordance with this embodiment, the platform assembly may be constructed of a water impermeable material, such as PVC coated vinyl. Preferably, the seams of the members comprising the platform assembly are sewn, bonded, or sewn and bonded with water impermeable threads and RF welded to provide air and water tight seals.

The inflatable display 62 is preferably made of a substantially flexible sheet material such as a polymer material, or any other material commonly used for making inflatable toys or rafts. Further, the material should be capable of being heat sealed. Preferably, the inflatable display is a three-dimensional form and may include a message area. Moreover, the inflatable display may comprise at least one individually inflatable compartment.

The inflatable display can be sewn to the first surface 74 of the base portion 72 of the platform assembly and then RF welded thereto, connected to the base portion 72 via fastener elements such as hook and loop or snap fasteners, lashed to the platform assembly in a manner similar to the mounting fastener and flap arrangement discussed above in relation to display apparatus 10, or connected to the platform assembly in any other known manner.

At least one blower duct 78 providing a conduit of pressurized gas, such as air, is preferably defined through one of the walls portions 64, 66, 68, 70 and is in communication with at least one interior volume 80 of the inflatable display 62 and a gas pressurizing source. Multiple blower ducts may be provided which either connect to respective interior volumes of the inflatable display, or connect to a single interior volume of the inflatable display. The inflatable display is provided with suitable valves which permit the expulsion of pressurized gas so the inflatable display may be deflated. The gas pressurizing source may be provided external to the platform assembly, or a gas pressurizing source may be provided on the platform assembly itself.

The inflatable display 62 preferably includes at least one pocket 86 containing a weight to maintain the display 62 in a desired shape upon inflation and deflation thereof. The pocket 86 may be defined as an underside of an inner or outer layer of the material used to construct the inflatable display. The weight can be any object or composition thereof, such as sand, which substantially maintains the display in a desired position or controls movement upon deflation thereof.

To inflate the inflatable display 62, a gas such as air is forced through the blower ducts to pressurize the interior volume. As the inflatable display inflates, the inflatable display rises from the base portion 72 of the platform assembly to increase in size. Once inflation is complete, the inflatable display 62 remains stationary and is supported by the platform assembly.

As shown in FIG. 10, when deflated the inflatable display 62 is contained within the walls 64 of the platform assembly 60. The inflatable display 62 is made to be self-supporting on the platform assembly 60, whether the platform assembly is located on dry ground or on a water surface and the inflatable display is able to stand erect and balanced by means of the platform assembly. Moreover, stability of the platform assembly and thus the inflatable display is enhanced by the ballast system 82, as discussed above in connection with display apparatus 10.

It will be understood that the inflatable display may include a variety of lighting, sound, motion sensors and interactive features such as smoke effects or water spraying capabilities. For example, the inflatable display may comprise the shape of a shark head having a mouth which includes lighting focused on the shark head and sound effects of a splash as the shark head projects water from its mouth. The shark head is configured to rise and fall, inflate and deflate according to motion sensors which detect the presence of individuals. These interactive features may be powered by a power source such a battery, solar panels connected to a battery, electric generator or power outlet connected to the platform assembly. Moreover, movement of the display device may be programmed in a desired fashion such as in a cycle of different motions, sights and sounds.

The platform assembly may additionally comprise tow devices and lighting configurations such as those described above in reference to display apparatus 10. Moreover, the platform assembly 62 may similarly be towed by a watercraft as the display apparatus 10 was shown in FIG. 1.

In all of the embodiments of the invention, it will be understood that structural members of the display apparatus may comprise singular or multiple inflatable members that may be separately inflatable. According to the invention, the structural members are preferably separately inflatable so as to minimize any leaks and reduce collapse of the display apparatus in the event any of the inflatable structural members rupture. Moreover, the structural members are provided with suitable valves that permit the selective entrance and expulsion of gas, such as air, therethrough.

The display apparatus of the invention may be scaled to any appropriate size, and be configured for either outdoor or indoor use. Moreover, the display apparatus is not limited to including the ballast system described herein, by may be modified to include any appropriate base deemed suitable for the particular application of the display apparatus.

Inflation of the members of the display apparatus may be accomplished either by permanent inflation, that is single inflation which lasts until the device is collapsed, or, and preferably, on-site blowers used to continuously force air within the interior of the inflatable members to maintain a desirable air pressure therein.

It will be understood that the above described embodiments of the invention may assume a variety of different shapes, sizes and configurations without departing from the scope of the present invention.

It will be understood that the above described embodiments of the invention are illustrative in nature, and that modifications thereof may occur to those skilled in the art. Accordingly, this invention is not to be regarded as limited to the embodiments disclosed herein, but is to be limited only as defined in the appended claims.

I claim:

1. A display apparatus, comprising:

at least two elongate pontoons provided in parallel arrangement, each of said pontoons having opposed first and second ends, and first and second sides;

a plurality of column members extending in a row from the first side of each of said pontoons; and an elongate transverse member provided in parallel arrangement to said pontoons, each of said column members connecting to the transverse member;

a ballast system including at least one elongate, ballast mounted to a generally horizontally extending surface of the second side of each of said pontoons and having opposed, open first and second ends that are structurally rigid, and a continuous, solid wall, tarpaulin material construction extending between the first and second ends for permitting water to only flow through the first and second ends, the structurally rigid first and second ends maintaining the ballast as an open conduit by preventing the continuous, solid wall, tarpaulin material from collapse and enabling ample fluid transport therethrough;

wherein the pontoons, the column members and the transverse member each comprise at least one independently inflatable compartment; and wherein each elongate ballast is generally coextensive with the generally horizontally extending surface of the second side of the pontoons.

2. The display apparatus according to claim 1, further comprising at least one display panel removably affixed to at least one row of the column members and extending between the transverse member and one of the pontoons.

3. The display apparatus according to claim 2, wherein the display panel is generally planar and has a leading edge, a trailing edge and two longitudinal edges, said leading and trailing edges connected to a first and last one of said column members in a corresponding row.

4. The display apparatus according to claim 2, wherein the display panel comprises a billboard made of pliable and permeable material bearing a graphical presentation.

5. The display apparatus according to claim 2, further comprising at least one illumination device arranged along one of the pontoons and directed to illuminate the display panel.

6. The display apparatus according to claim 1, wherein each of the ballasts is generally semicircular in lateral cross-section.

7. The display apparatus according to claim 1, wherein the ballasts extend along the entire longitudinal length of the pontoons.

8. The display apparatus according to claim 1, further comprising at least one laterally extending cross-beam member connecting to the pontoons.

9. The display apparatus according to claim 8, wherein said display apparatus is generally trapezoidal in lateral cross-section, said transverse member defining a narrow top portion and said column members extending therefrom at an angle to the pontoons to define a wider bottom portion with the cross-beam member.

10. The display apparatus according to claim 1, wherein the second side of each pontoon includes the generally horizontally extending surface of the second side at a middle portion thereof, and the second side of each pontoon further comprises obliquely sloped or tapered end surfaces; and the ballast system extends between the obliquely sloped or tapered end surfaces.

11. An advertising display, comprising:

a display apparatus having a base portion, and a display support portion extending vertically from the base portion, said display apparatus defining opposed first and second ends, and first and second sides;

at least one display feature bearing at least one graphic presentation connected to the display apparatus;

at least one tow device mounted to the display apparatus along at least one of the first and second ends; and a ballast system connecting to the base portion of the display apparatus, the ballast system including at least one elongate, ballast coextensive with and mounted to a generally horizontally extending surface of the second side of the display apparatus and having opposed, open first and second ends that are structurally rigid, and a continuous, solid wall, tarpaulin material construction extending between the first and second ends for permitting water to only flow through the first and second ends, the structurally rigid first and second ends maintaining the ballast as an open conduit by preventing the continuous, solid wall, tarpaulin material from collapse and enabling ample fluid transport therethrough.

12. The advertising display according to claim 11, wherein the display feature is mounted along at least one of the first and second sides of the display support portion of the display apparatus.

13. The advertising display according to claim 11, wherein the display apparatus includes inflatable members each having at least one individually inflatable compartment.

14. The display apparatus according to claim 11, wherein the second side of the display apparatus includes the generally horizontally extending surface of the second side at a middle portion thereof, and the second side of the display apparatus further comprises obliquely sloped or tapered end surfaces; and the ballast system extends between the obliquely sloped or tapered end surfaces.

15. A floatable display apparatus, comprising:

at least two elongate pontoons provided in parallel arrangement, each of said pontoons having opposed first and second ends, and first and second sides;

a plurality of column members extending in a row from the first side each of said pontoons;

an elongate transverse member provided in parallel arrangement to said pontoons, each of said column members connecting to the transverse member;

at least one elongate ballast coextensive with and mounted to a generally horizontally extending surface of the second side of each of said pontoons, and having opposed, open first and second ends having a first stiffness, and a continuous tarpaulin material construction, having a second stiffness that is much less than the first stiffness, extending between the first and second ends for permitting water to only flow through the first and second ends, the first and second ends configured to maintain the ballast as an open conduit by preventing the tarpaulin material from collapsing and enabling ample fluid transport therethrough; and at least one display feature connected to at least one of the column members.

16. The floatable display apparatus according to claim 15, wherein the at least one display feature is removably affixed to at least one row of the column members and extends at least between the transverse member and one of the pontoons.

17. The floatable display apparatus according to claim 15, wherein the at least one display feature is generally planar and has a leading edge, a trailing edge and two longitudinal edges, said leading and trailing edges connected to a first and last one of said column members in a corresponding row.

18. The floatable display apparatus according to claim 15, wherein the display feature comprises a billboard made of pliable and permeable material bearing a graphical presentation.

19. The floatable display apparatus according to claim 15, further comprising at least one laterally extending cross-beam member connecting to the pontoons, the display apparatus being generally trapezoidal in lateral cross-section, said transverse member defining a narrow top portion and said column members extending therefrom at an angle to the pontoons to define a wider bottom portion with the cross-beam member.

20. The display apparatus according to claim 15, wherein the second side of each pontoon includes the generally horizontally extending surface of the second side at a middle portion thereof, and the second side of each pontoon further comprises obliquely sloped or tapered end surfaces; and the ballast extends between the obliquely sloped or tapered end surfaces.

* * * * *